United States Patent [19]

Burnside

[11] 3,993,312

[45] Nov. 23, 1976

[54] CHANGEABLE DISPLAY APPARATUS

[75] Inventor: Walter M. Burnside, Waukegan, Ill.

[73] Assignee: Bally Manufacturing Corporation, Chicago, Ill.

[22] Filed: Sept. 8, 1975

[21] Appl. No.: 611,127

[52] U.S. Cl. ..... 273/121 A; 40/65; 273/138 A

[51] Int. Cl.[2] ..... A63D 13/00

[58] Field of Search..... 273/118 A, 119 A, 121 A, 273/122 A, 123 A, 124 A, 125 A, 138 A

[56] References Cited

UNITED STATES PATENTS

| | | | |
|---|---|---|---|
| 2,882,057 | 4/1959 | Hooker | 273/125 A |
| 2,932,517 | 4/1960 | Hooker et al. | 273/119 A |
| 3,399,896 | 9/1968 | Burnside | 273/138 A |

*Primary Examiner*—Anton O. Oechsle

*Attorney, Agent, or Firm*—Hibben, Noyes & Bicknell, Ltd.

[57] ABSTRACT

In a pin ball game apparatus a Bingo-type score card having a shiftable mask plate associated therewith for changing the score value of a winning combination where the mask plate is reciprocably movable vertically in opposite directions from a center position relative to the score card by a rotatable cam connected to a lever arm supporting the mask plate, a locking mechanism associated with the lever arm which restrains the movement of the mask plate away from the center position in at least one direction, and a spring biased linkage interposed between the rotatable cam and the lever arm which permits the cam to be rotated 360° while the locking mechanism restrains movement of the mask plate away from the center position in at least one direction.

6 Claims, 8 Drawing Figures

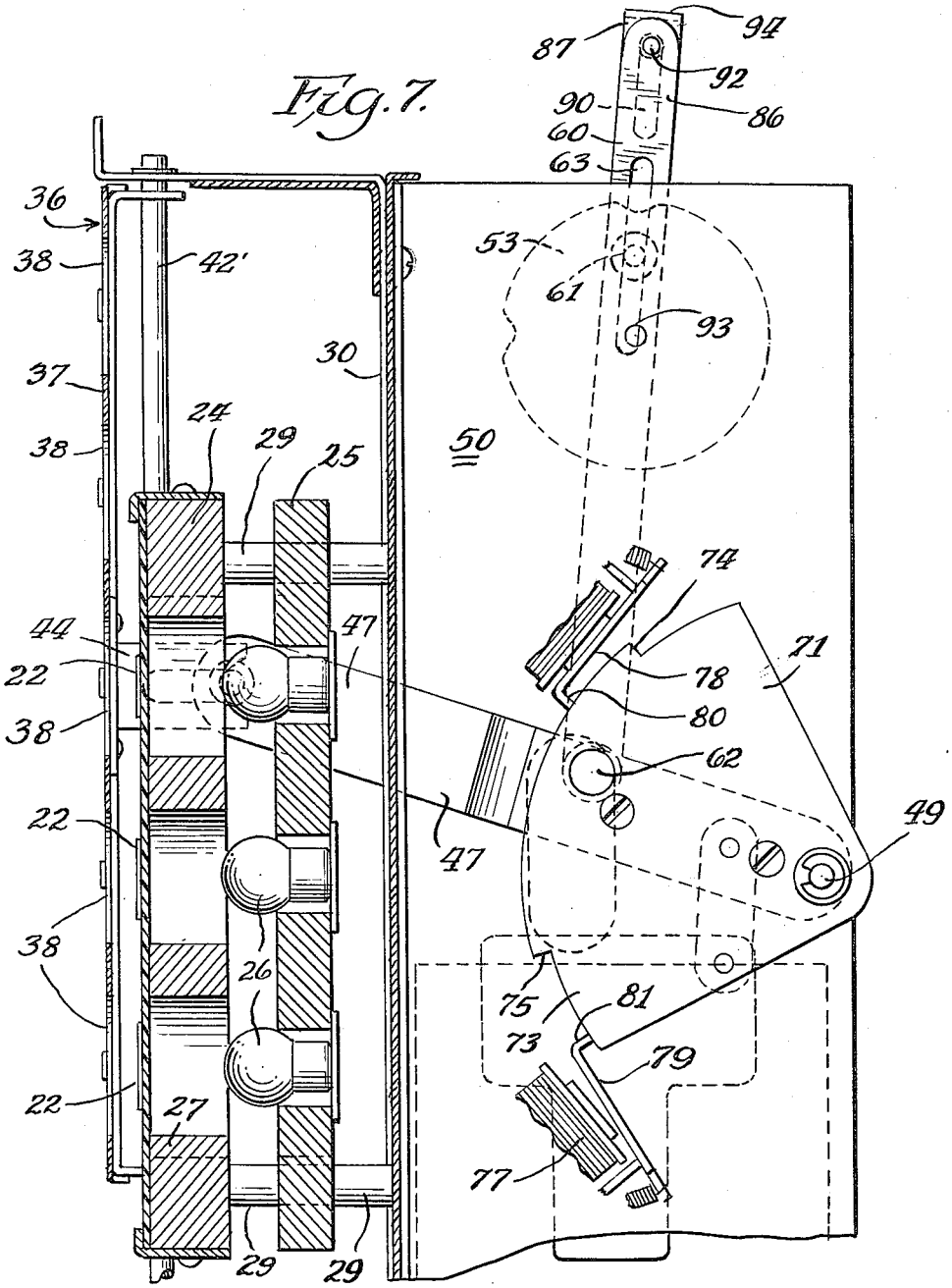
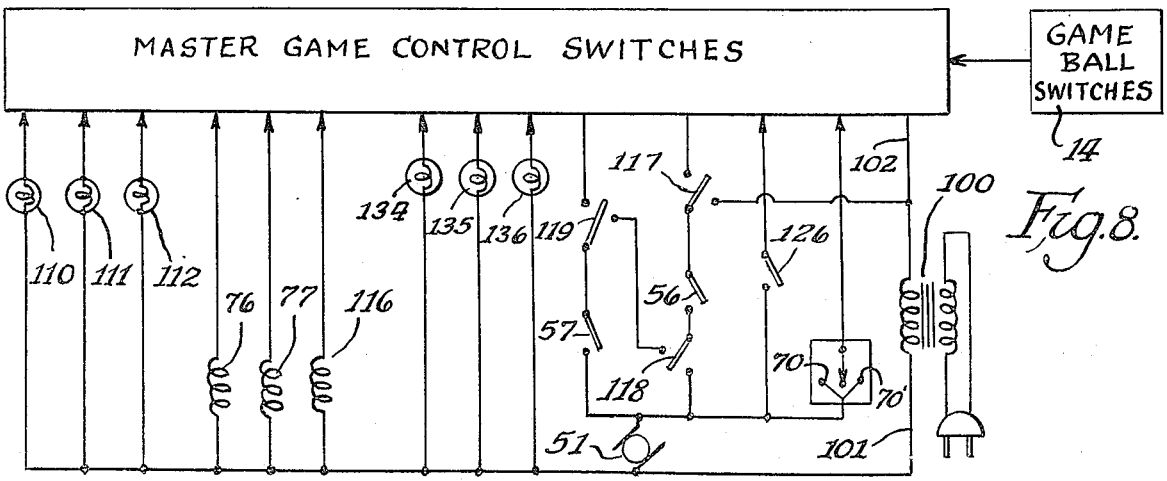
Fig. 8.

CHANGEABLE DISPLAY APPARATUS

The present invention relates generally to a changeable display apparatus and more particularly to an amusement apparatus incorporating a "Bingo" type score card with a changeable display panel associated therewith.

In a Bingo-type game apparatus, preferably employing ball-rolling means to build a winning combination of three or more in-line indicia on the score card it has been found desirable to provide means for a player to change the score card during the course of play to increase the score value by changing the arrangement of the numbers forming the score card (See U.S. Pat. No. 3,399,896) or by changing the color indicia of the card (See U.S. Pat. No. 3,004,357), thereby increasing interest in continuing play of the game. In any such apparatus it is important that the mechanism for changing the score card display be simple to operate, reliable in operation and require a minimum of maintenance.

It is therefore an object of the present invention to provide a shiftable display mechanism which is simple to operate, reliable in operation and require a minimum of maintenance.

It is a further object of the present invention to provide improved shifting mechanism for moving a display panel relative to a fixed panel into and out of selected relative positions.

A still further object of the present invention is to provide an improved mechanism for moving a display panel relative to a fixed "Bingo"-type score card.

Another object of the present invention is to provide in a pin-ball game apparatus an improved changeable display "Bingo"-type score card.

Other objects of the present invention will be apparent from the detailed description and claims to follow when used in conjunction with the accompanying drawing, wherein:

FIG. 7 is a fragmentary side elevational view taken along the line 7—7 of FIG. 2 in a position of adjustment different from that shown in FIG. 6; and FIG. 8 is a schematic circuit diagram for the apparatus of FIG. 2.

Figure 1:
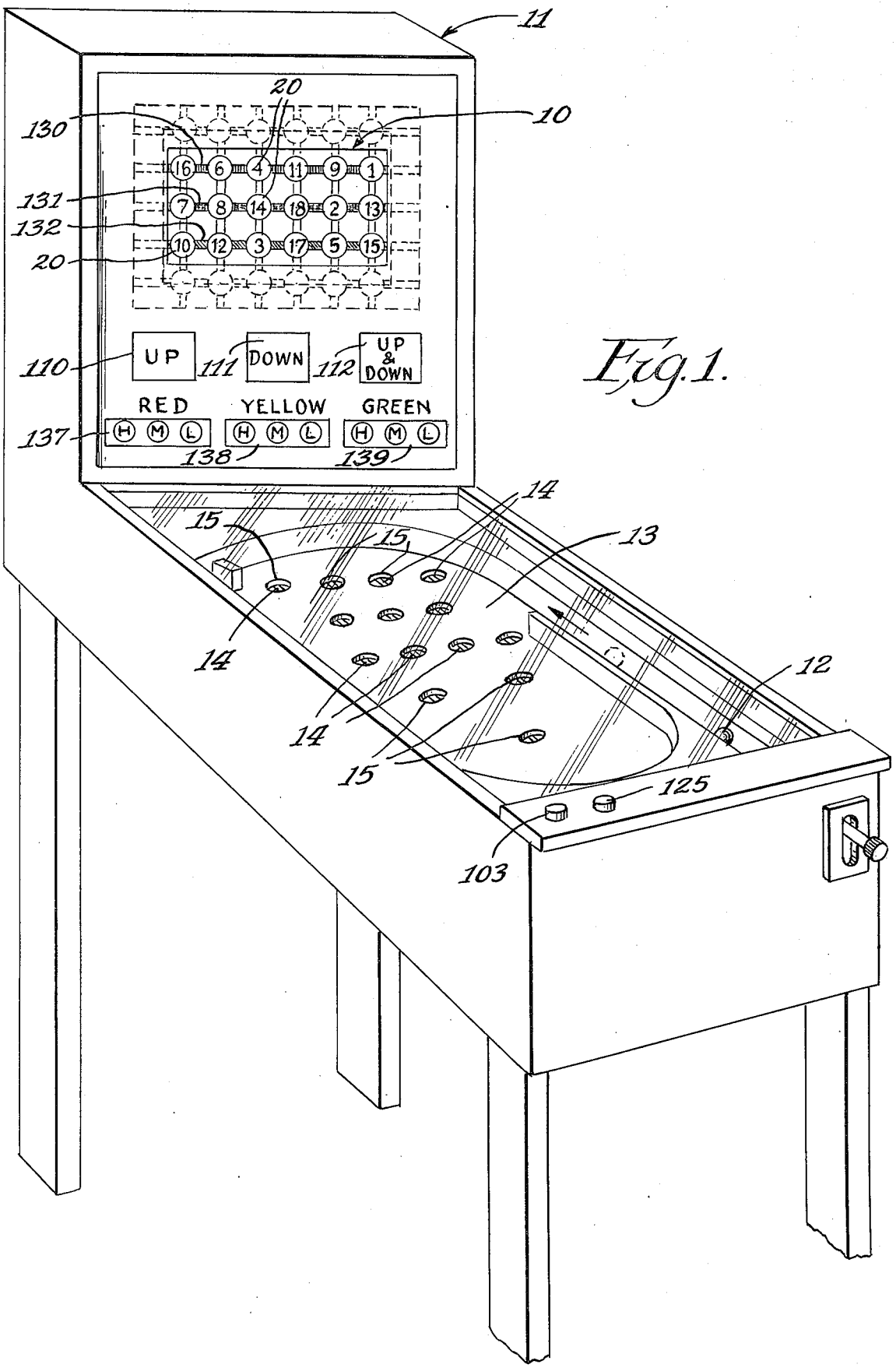
FIG. 1 is a perspective view of a pin-ball game apparatus embodying the changeable display apparatus of the present invention.
Figure 2:
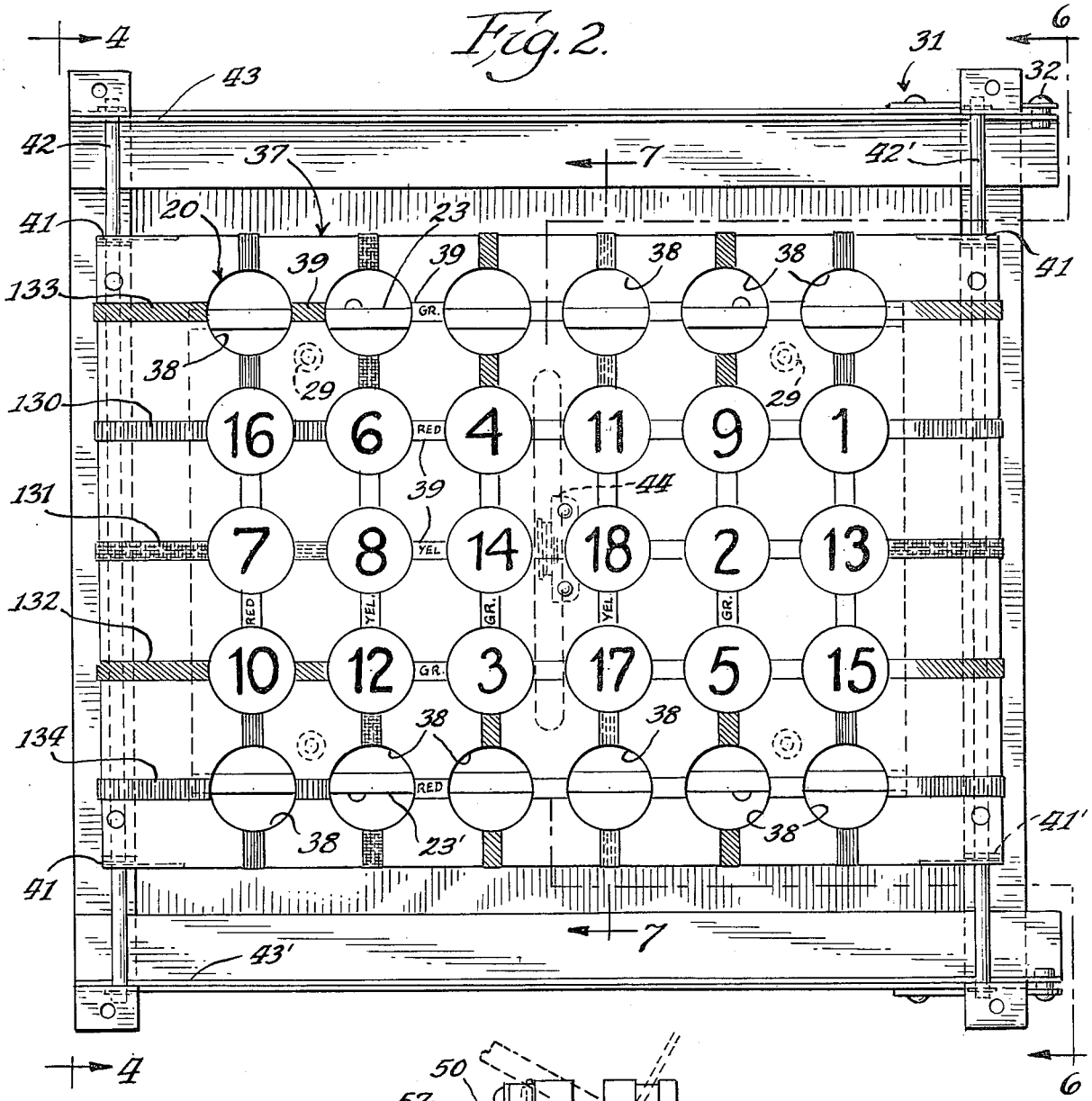
FIG. 2 is a front elevational view of the changeable display apparatus of FIG. 1.
Figure 3:
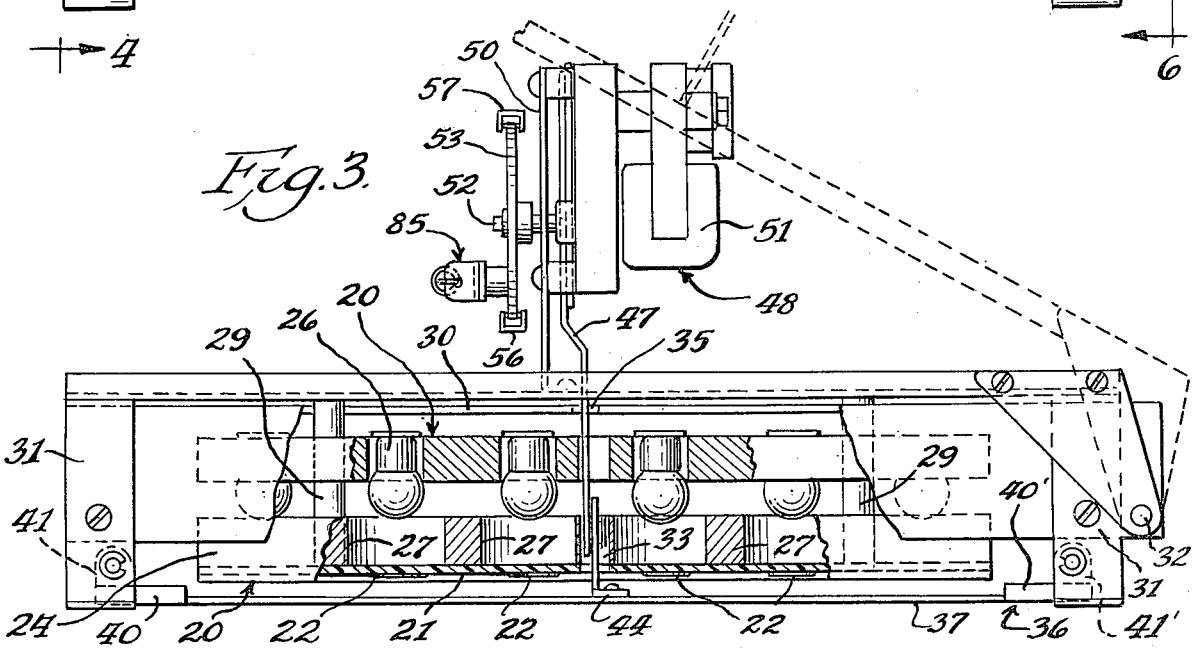
FIG. 3 is a top plan view of the apparatus of FIG. 2 partially in section.
Figure 4:
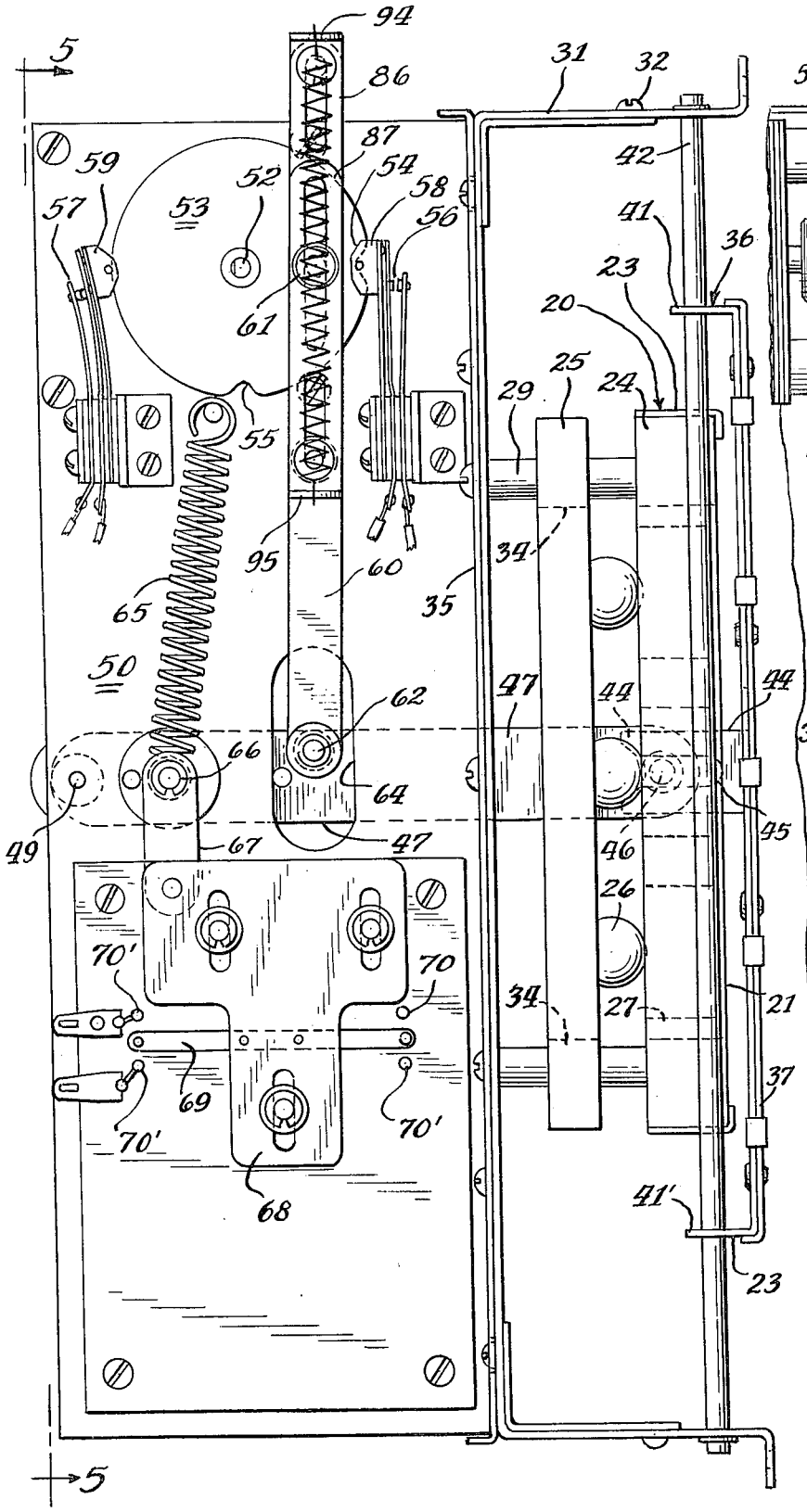
FIG. 4 is a side elevational view taken along the line 4—4 of FIG. 2.
Figure 5:
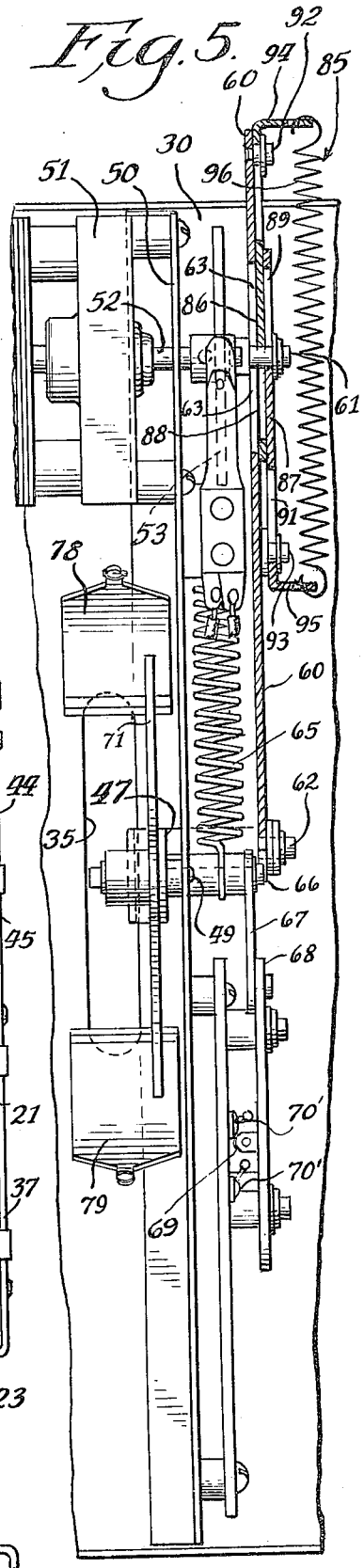
FIG. 5 is a fragmentary rear elevational view partially in vertical section of the apparatus of FIG. 1.
Figure 6:
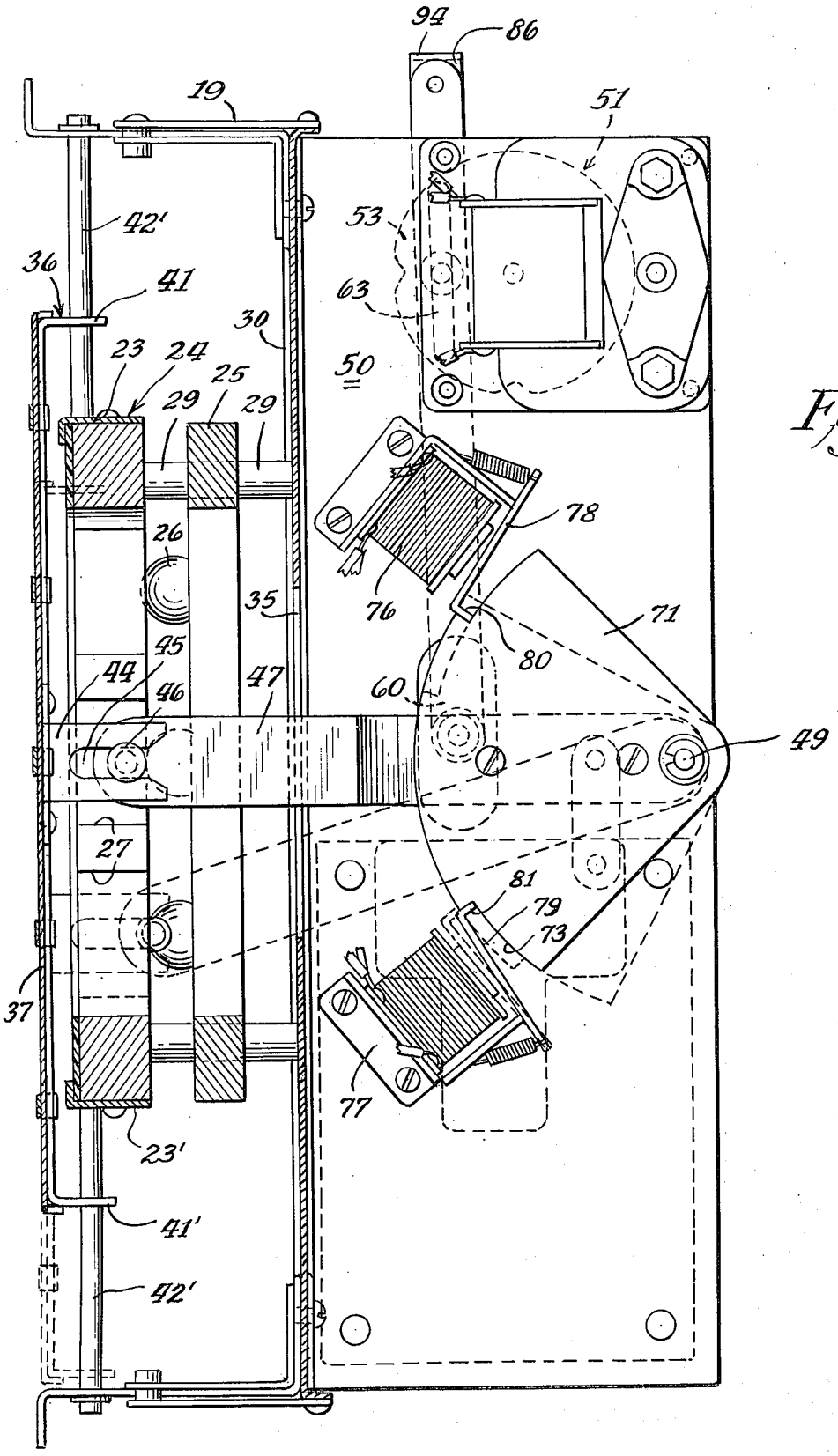
FIG. 6 is a side elevational view taken along the line 6—6 of FIG. 2.

In FIG. 1 the changeable display apparatus 10 of the present invention is shown embodied in a pin-ball game structure 11 in which 12 balls are adapted to be rolled along a play surface 13 to effect closing of game ball switches 14 mounted in a ball-receiving openings 15 on the play surface 13. When one of the game ball switches 14 is closed the indicia (i.e., numbers) in the fixed display panel 20 corresponding with the number of the openings on the play surface into which the game ball was rolled will be illuminated. The player endeavors to roll game balls into openings 15 on the play surface 13 so as to illuminate three in-line indicia on the core card which will give the highest score value.

In the illustrated pin-ball "Bingo"-type game apparatus embodying the changeable display apparatus of the present invention the fixed display panel assembly 20 comprises a rectangular translucent plate 21 with indicia or score numbers 22 arranged thereon in three vertically spaced horizontal lines of six numbers each so as to form a Bingo-type score card. The rectangular translucent plate 21 is supported along its lower and upper edges in retaining grooves formed by inwardly extending flanges on the retaining trips 23, 23' secured to the upper and lower edges respectively of the support member 24. The support member 24 is mounted forwardly of and in spaced relationship with a lamp board 25 having a plurality of electric lamps 26 mounted therein. The lamps 26 are mounted directly behind each of the indicia 22 on the plate 21 and in axial alignment with the passages 27 formed in the support member 24. The fixed display panel assembly 20 is secured by means of a plurality of fastener means 29 to the back plate 30 which is mounted on a frame structure 31. The support member 24, lamp board 25, and the back plate 30 each has formed therein a vertically extending passage 33, 34, 35, respectively, extending therethrough along the vertical axis thereof.

A changeable display panel 36 is disposed forwardly of the fixed display panel assembly 20 and comprises an opaque rectangular rigid mask plate 37 having a plurality of sight-openings 38 formed therein which are arranged in five vertically spaced horizontally extending rows with each row being marked with a horizontal color bar 39 having a particular color designation. The spacing and arrangement of the sight openings 38 correspond with the spacing and arrangement of the indicia 22 on the plate 21 which form the score card of the Bingo-type game. The plate 37 is secured along each of the opposite lateral edges by lateral support brackets 40, 40' provided with lugs 41, 41' at the upper and lower ends thereof, respectively, for slidably mounting the mask plate 37 on vertically extending guide rods 42, 42' secured between the upper and lower frame members 43, 43'. Attached to the inner or rear surface of the sheet 37 is an L-shaped bracket 44 having bifurcated arms extending perpendicular rearwardly through the passage 33 and forming a slot 45 for receiving a stud 46 formed on the end of the operating arm 47 of the shift mechanism 48 which is adapted to reciprocably move the changeable display panel 36 relative to the fixed display panel 20.

The shift mechanism 48 comprises a power unit 51, such as an electric motor, mounted on a support plate 50 which extends rearwardly perpendicular to the back plate 30. The support plate 50 is attached to a bracket which is hingeably mounted on the frame 31, as at 32, 32'. The power unit 51, through suitable reduction gears, is adapted to turn a drive shaft 52 extending through a passage in plate 50 having a circular cam 53, mounted on the outer end thereof. The cam 53 has two recesses 54, 55 which are circumferentially spaced about 90° formed in the peripheral surface thereof. Leaf spring switches 56, 57 are mounted on the support plate 50 adjacent the cam 53 at diametrically opposite edges of the cam 53. The outer ends of the cam contact arms 58, 59 provided on switches 56, 57, respectively, are adapted to resiliently engage the peripheral surface of the cam 53 as the cam 53 is rotated counterclockwise by the shaft 52. When the outer end of the contact arms 58 or 59 drops into one of the recesses 54, 55 of the cam, switch 56 ot 57 will be in open position. And, when the outer end of the contact arm 58 or 59 is not in one of the recesses 54, 55, the switch associated therewith will be in closed position.

The circular cam 53 is operatively connected with the link 60 by a pin 61 adjacent the outer periphery of the cam with the pin 61 adapted to engage in an elongated slot 63 formed in the link 60. A spring-biased linkage 85 to be described in detail hereinafter is supported by the upper portion of link 60. The lower end of the link 60 is connected to the operating arm 47 by a pin 62 which extends transversely through a passage 64 formed in the plate 50. The link 60 is connected to the arm 47 at a point forwardly of the pivotal support 49 for the arm 47 on the plate 50 so that when the cam 53 is rotated the arm 47 is adapted to be moved reciprocably in a vertical plate. A counter-balancing spring 65 is secured to the arm 47 by a pin 66 with the outer end of the spring 65 anchored to the plate 50. The spring 65 is adapted to facilitate moving the arm 47 upwardly so that the rotating cam 53 is not required to hold or lift the entire weight of the changeable display panel 36. A second link 67 is also secured to the operating lever arm 47 by the pin 66. The lower end of the link 67 is connected to a reciprocable wiper support member 68 slidably mounted on the support plate 50. The support member 68 has a wiper arm 69 adapted to contact spaced electrical contacts 70, 70' which are connected with the Master Game Control Switches.

The operating arm 47 has a locking means connected therewith which is adapted to restrain the reciprocal movement of the arm 47 and comprises a reciprocal cam 71 pivotally mounted at the outer end thereof to the plate 50 by the pin 49 and is connected to the operating cam 47 and link 60 by the pin 62 at a point adjacent the forward edge thereof. The cam 71 has cut-out portions 72, 73 formed in the inner peripheral surface which extend inwardly from the opposite ends thereof to provide abutment surfaces 74, 75 respectively. A cam lock release means 76, 77 is mounted on plate 50 opposite each of the cutout portions 72, 73, respectively. Each of the latching means 74, 75 has a spring biased latch arm 78, 79, respectively, provided with a depending end portion 80, 81, respectively. Each of the end portions 80, 81 is adapted to be held in resilient engagement with the peripheral surface of the cam 70. The end portions 80, 81 of the latch arms 78, 79, respectively, normally engaged the abutment surfaces 74, 75, respectively, on the cam 70 so as to restrain the reciprocal movement of the cam 70 and the operating arm 47 in either an upwardly or downwardly direction. Either one or both of the latch arms 78, 79 are adapted to be retracted so that the end portions 80, 81, respectively, do not engage the abutment surfaces 74, 75; thereby permitting reciprocal movement of the cam 71 and operating arm 47, only upwardly, or only downwardly or both upwardly and downwardly. The cam lock release means 76 is adapted to withdraw the "Up" release arm 78 from locking engagement with the cam 71. The cam lock release means 77 is adapted to withdraw the "Down" release arm 79 from locking engagement with the cam 71.

In order to permit moving the display shift operating arm 47 in only an upwardly or in only a downwardly direction without providing a reversible driving means for the rotary cam 53, a mechanical override or release linkage means 85 is interposed between the rotary cam 53 and the operating lever arm 47. In the preferred form illustrated in the drawings, the release linkage means 85 comprises a pair of superimposed, spring biased, reciprocably moving elements 86, 87 which are mounted on the link 60 for slidable longitudinal relative movement. Each of the elements 86, 87 has an elongated slot 88, 89, respectively, formed adjacent the inner ends thereof in which the pin 61 slidably engages. The elements 86, 87 also have an elongated slot 90, 91, respectively, adjacent the outer ends thereof. The slot 90 is adapted to receive a stud 92 which extends outwardly from link 60 adjacent the outer end thereof, and the slot 91 is adapted to receive a stud 93 which extends outwardly from the link 60 at a point between pins 61, 62. The studs 92, 93 are positioned on opposite sides of the pin 61 and at equal distances from the pin 61. Outwardly extending flanges 94, 95 are formed at the outer ends of the elements 86, 87, respectively. A tension spring 96 extends between the flanges 94, 95 and resiliently holds the elements 86, 87 in retracted position with the elements 86, 87 in maximum overlapping relationship. The length of each of the slots 63, 88, 89, 90, 91 formed in the linkage elements 60, 86, and 87 is such that the elements 86, 87 can be moved a sufficient distance to permit the cam 53 to be rotated throughout a 360° revolution without effecting movement of the link 60 while the operating arm 47 is restrained from reciprocal movement by the locking means. The spring 96 is adapted to exert sufficient tension on the elements 86, 87 to prevent relative movement therebetween when the arm 47 is not restrained by the locking means, but will not apply sufficient tension to prevent the elements 86, 87 being moved apart by the rotation of the cam 53 when the arm 47 is restrained by the locking means.

At the beginning of each play cycle when the master control button 103 is depressed, if the mask plate 37 has been left in the "Up" or "Down" position at the end of the previous play cycle so that the wiper arm 69 electrically connects either of the contact point 70 or 70', the Master Game Control Switches will automatically return the mask plate 37 to its home or neutral position. Thus, before play starts the mask plate 37 will be in the central or home position with the three middle rows 130, 131 and 132 of sight-openings in the mask plate 37 in alignment with the three horizontal lines of indicia forming the score card on the fixed plate 21. In the latter position the shiftable mask plate 37 designates the uppermost line of numerals on the score card as a "Red" line, the middle row as "Yellow" line and the lowermost row as a "Green" line. In addition the mask panel 37 has a top row 133 and a bottom row 134 of sight-openings which are designated "Green" and "Red", respectively. The rows of sight-openings 133 and 134 are normally not in the viewing area of the front panel 18 when mask plate 37 is in center position.

FIG. 8 of the drawing shows schematically a diagram of the electrical circuit for operating the shiftable display panel 36. The circuit includes a transformer 100 which provides electrical power to the lines 101, 102. The power line 102 supplies electricity to the Master Game Control Switches forming a plurality of game control circuits (not shown) which are electrically connected with the game ball switches 14 and control the electrical components illustrated in FIG. 8. When the master control button 103 is depressed at the start of each game, one of the master control circuits operates a random selector means for determining which (if any) of the reciprocal movements of the changeable display panel 36 can be made by the player during the play cycle. When the random selector means has completed its selection, the master control switches will cause one of the windoes 110, 111, or 112 which display the indicia "Up," "Down," and "Up and Down," respectively, on the front panel 18 of the game apparatus 11 to be illuminated. At the same time the Master Game Control circuit which has illuminated one of the windows 110, 111, or 112 will activate a circuit energizing one of the cam lock release means 76 or 77 (or both) or the relay 116. The relay 116 is adapted to affect the "Both Way" or "Up or Down" movement of the mask plate 37 by controlling switches 117, 118 and 119 and energizing both the Up and Down cam lock release means 76, 77 to effect withdrawing both the Up and Down release arms 78, 79, respectively, from locking engagement with the cam 71.

The Master Game Control Switches will also automatically deactivate the Down cam switch 57 in the event Up movement of the mask plate 37 has been selected, and the Up cam switch 56 will be deactivated in the event the Down movement of the mask plate 37 has been selected. In the event that both the Up and Down movements have been selected by the random selector means, neither of the cam switches 56 or 57 will be deactivated. If the random selector means has failed to stop on an active contact, none of the foregoing releases, switches or relays will be affected.

Simultaneously with the closing of master game switch 103, a second random selector circuit is activated by the Master Game Control Switches which will energize only one of three lights 134, 135, 136 displaying indicia "H," "M" or "L" in each of the windows 137, 138 and 139 on the front panel 18. The windows 137, 138, 139 are also designated by the indicia "Red," "Yellow," and "Green", respectively. The color designation of the window in which the H appears will have the highest score value, the color designation of the window in which the M appears will have a medium score value, and the color designation of the window in which the L appears will have the lowest score value.

If it is assumed that the Red window 137 is designated by the indicia H, and the Green window 139 is designated by the indicia L, the line of indicia (numerals) on the score card which is designated by a Red color bar on the mask plate 37 will have the highest score value and the Green line will have the lowest score value. And, if it is assumed that the changeable display panel can be moved only in the Up direction, as a result of the random selection means illuminating window 110, a player will obtain the highest score value, if he is able to align at least three adjacent "numbers" in a line having a Red color bar designation as a result of rolling the game balls on the playing surface 13 or by shifting the mask plate 37 in the Up direction.

If during the course of play, a player decides he would have a better chance of improving his score by shifting the mask plate 37 upwardly from its "home" or center position, as when the numbers 10 and 12 are illuminated and are in the Yellow row 132 when the mask plate 37 is in the center position, the player will momentarily depress the spring biased selector button 125 which closes switch 126 and energizes the drive motor 51 to effect rotation of cam 53 in a counterclockwise direction. Since switch 117 is normally spring biased so as to close the circuit from the Master Game Control Switches to the cam switch 56 and since the switch 56 is closed as soon as the outer ends of the cam actuating arm 58 is moved out of the cam recess 54 by the rotation of drive motor 51, the drive motor 51 will continue to rotate cam 53 in a counterclockwise direction until the end of switch control arm 58 drops into the cam recess 55, causing switch 56 to open and de-energize the drive motor 51. The cam 53 will have thus been rotated 90°, and the link 60 and shift operating arm 47 will be in its elevated position so that the mask plate 37 is in the Up position relative to the score card. Should the player decide not to have the mask plate 37 in the Up position, he would momentarily depress selector button 125 to reenergize the drive motor 51 and close switch 56 so that motor 51 would be rotated in a counterclockwise direction until the end of the switch control arm 58 again drops into cam recess 54. In this manner link 60 is returned to its home or center position. As switch 57 was deactivated by the Master Game Control Switches at the start of play, the switch control arm 59 rides over the cam recesses 54, 55 without effecting the starting or stopping of the drive motor 51.

Since the random selector and the master game control switches have dictated that the mask plate 37 can be moved only in the Up direction and has left the Down latch arm 79 in locking engagement with the cam 71, the cam 53 could not rotate counterclockwise through a complete 360° revolution without having the cam override or release linkage means 85 interposed between the rotating cam 53 and the operting arm 47. Thus, when the pin 61 on the cam 53 has moved 180° from its starting position and is moved downwardly while the operating arm 47 remains locked against being moved downwardly, the linkage element 86, 87 are moved longitudinally in diametrically opposite directions against the tension of the spring 96 with the pin 61 sliding longitudinally in the slot 63 of link 60 and the pins 92, 93 slidably engage in slots 90, 91, respectively. As the cam pin 61 completes its 360° revolution, the linkage elements 86, 87 are returned to their normal overlapping relationship under the tension of spring 96. In the foregoing manner mask plate 37 is moved to the Up position so as to change the color line designation for the rows of numerals on the score card without the mask plate having to be cycled through the Down position on the traverse from Up to the center or home position.

Where the random selector circuit has dictated that the mask plate 37 can be shifted only in the Down direction, the Master Game Control Switches will remove the Up cam switch 56 from the circuitry and will return the mask plate 37 to center position with the outer end of the operating arm 59 of cam switch 57 being seated in the cam recess 54. The Master Game Control Switches will also energize cam lock release means 75 which will withdraw the latch arm 79 from locking engagement with cam 71 without withdrawing the Up latch arm 78 from locking engagement with cam 71. Thus, when the player elects to move the mask plate 37 to the Down position, the selector button 125 is depressed momentarily closing the switch 126 to energize drive motor 51 and move the end of arm 59 out of the cam recess 54 so that cam switch 57 is closed. Drive motor 51 continues to rotate cam 53, moving the link 60 and mask plate 37 downwardly, until the end of the switch control arm 59 drops into the cam recess 55. The mask plate 37 will then be in the Down position and will remain in the Down position until the player again depresses selector button 125 or the Master Game Control Switches return the mask plate 37 to its center position at the beginning of the next game.

If the random selector circuit of the Master Game Control Switches has dictated that the mask plate 37 can be shifted in both the Up and Down directions, as indicated by the lighting of window 112, the Master Game Control Switches will return the mask plate 37 to center position without deactivating either of the cam switches 56, 57 and will energize both the Up and the Down cam lock release means 76, 77. In addition, the Master Game Control Switches will move clockwise each of the switches 117,118, 119 from their normal closed position in the circuit between the Master Game Control Switches and the drive motor 51 and will form a direct circuit from the power line 102 through the Up cam switch 56 and the Down cam switch 57 to the cam drive motor 51. Thus, when the elector button 125 is depressed to close switch 126, the drive motor 51 is energized, rotating cam 53 and closing both cam switches 56, 57. The cam 53 will continue to rotate until the outer end of either of the cam operating arms 58, 59 drops into cam recess 55 to open the circuit to the drive motor 51 at which time the cam 53 will have rotated 90° and the mask plate 37 has been shifted to the off-center (up or down) position of adjustment. When the selector button 125 is again depressed, the cam will be rotated another 90° to return the mask plate 37 to enter position, at which time the circuit to motor 51 will again be opened by one of the cam switches 56, 57. In a like manner each time the selector button 125 is depressed, the cam 53 will be rotated 90° before stopping in either the Up, the Down or the Center position.

I claim:

1. In a changeable display apparatus having a fixed display panel and a shiftable display panel which is movable relative to the fixed display panel, 1. a rotatable cam means operatively connected with a lever arm which supports said shiftable display panel and said rotatable cam means adapted to reciprocably move said lever arm from a center position in generally diametrically opposite directions and returning said lever arm to said center position,
2. locking means associated with said lever arm adapted to restrain movement of said lever arm from said center position in at least one of said opposite directions, and
3. a mechanical release means interposed between said rotatable cam means and said lever arm which allows a cam element incoporated in said cam means to be rotated 360 degrees while said locking means restrains movement of said lever arm from said center position in at least one of said opposite directions; whereby said shiftable display panel is movable in one direction away from a center position and back to center position by a cam which is rotatable in only one direction while said shiftable display panel is restrained from being moved from said center position in an opposite direction.

2. A changeable display apparatus as in claim 1, wherein said locking means for said lever arm comprises a cam element which is secured to said lever arm and movable therewith having cutout portions forming an abutment surface in the peripheral surface adjacent the opposite ends thereof, a latch member disposed adjacent each said opposite ends of said peripheral surface which is normally held in locking engagement with said abutment surface preventing reciprocable movement of said cam element toward each said latch member in locking engagement therewith, and means for withdrawing a said latch member out of locking engagement with said abutment surface to permit moving the said cam element toward the said latch member which has been moved out of locking engagement therewith.

3. A changeable display apparatus as in claim 1, wherein said mechanical release menas comprises a lever arm operating link which is connected with a generally circular cam of said rotatable cam means by a pin element extending from the lateral surface of said cam at a point spaced from the axis of the cam with the said pin element slidably engaging in a longitudinally extending slot formed in said link and having one end of the said link operatively connected to said lever arm for effecting reciprocable movement thereof, a pair of slidable elements supported by said link in overlapping relationship at the inner ends thereof, said slidable elements each having a longitudinally outwardly extending slot formed in the inner end portion of each said element which is adapted to slidably engage the said pin element, each said slidable element also having a longitudinally inwardly extending slot formed in the outer end portion thereof in which spaced lugs extending outwardly from said link on opposite sides of the said pin element are adapted to slidably engage, and each said slidable element having at the outer end thereof means for engaging the end of a tension means which is adapted to resiliently hold said slidable elements in maximum overlapping relationship; whereby said slidable elements are movable outwardly against the force of said tension means to allow said cam to be rotated through a 360 degree revolution to effect movement of the shiftable display means away from center position in one direction and returning to the center position when the said shiftable display means is restrained from being moved away from said center position in the opposite direction.

4. An apparatus as in claim 1, wherein said fixed display panel is a Bingo-type score card formed of a plurality of individual indicia arranged in vertically spaced horizontal lines with means associated therewith for selectively illuminating individual indicia and said shiftable display panel comprising a shiftable mask plate which is disposed forwardly of said score card and which has a number of vertically spaced horizontal rows of sight-openings formed therein in excess of the number of said lines of indicia forming said score card, and said mask plate adapted to be vertically reciprocably moved to effect shifting of said rows of sight-openings away from a center position of alignment with said lines of indicia into another position of alignment relative to the said lines of indicia and returning said mask plate to center position.

5. An apparatus as in claim 4, wherein said rows of sight-openings of said mask plate have associated therewith indicia designating a score value of a winning Bingo-type combination in the said lines of indicia of said score card for each of the shiftable positions of adjustment of said mask plate.

6. An apparatus as in claim 5, wherein said indicia associated with each said row of sight-openings consists of a distinctive color designation.

* * * * *

UNITED STATES PATENT OFFICE

CERTIFICATE OF CORRECTION

PATENT NO. : 3,993,312

DATED : November 23, 1976

INVENTOR(S) : Walter M. Burnside

It is certified that error appears in the above-identified patent and that said Letters Patent are hereby corrected as shown below:

Col. 1, line 60, "12 balls" should read --balls 12--.

Col. 2, line 2, "core card" should read --score card--.

Col. 2, line 12, "retaining trips" should read --retaining strips

Col. 3, lines 1 and 2, "recesses 54, 55 of the cam" should read --recesses 54, 55 of the cam 53--.

Col. 5, line 5, "windoes" should read --windows--.

Col. 7, line 19, "elector button 125" should read --selector button 125--.

Col. 7, line 30, "enter position" should read --center position--

Col. 8, line 12, "menas" should read --means--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*